US010431902B2

(12) United States Patent
You et al.

(10) Patent No.: US 10,431,902 B2
(45) Date of Patent: Oct. 1, 2019

(54) WAVEGUIDE SLOTTED ARRAY ANTENNA

(71) Applicant: Ningbo University, Zhejiang (CN)

(72) Inventors: Qingchun You, Zhejiang (CN); Jifu Huang, Zhejiang (CN); Liting Qin, Zhejiang (CN); Yang You, Zhejiang (CN)

(73) Assignee: Ningbo University, Zhejiang (CN)

( * ) Notice: Subject to any disclaimer, the term of this patent is extended or adjusted under 35 U.S.C. 154(b) by 0 days.

(21) Appl. No.: 15/964,054

(22) Filed: Apr. 26, 2018

(65) Prior Publication Data

US 2018/0358709 A1 Dec. 13, 2018

(30) Foreign Application Priority Data

Jun. 9, 2017 (CN) ..... 2017 1 0429885

(51) Int. Cl.

| | |
|---|---|
| ***H01Q 21/06*** | (2006.01) |
| ***H01Q 21/00*** | (2006.01) |
| ***H01Q 13/18*** | (2006.01) |
| ***H01Q 13/10*** | (2006.01) |
| ***H01Q 15/24*** | (2006.01) |
| ***H01Q 21/24*** | (2006.01) |

(52) U.S. Cl.

CPC ..... *H01Q 21/064* (2013.01); *H01Q 13/10* (2013.01); *H01Q 13/106* (2013.01); *H01Q 13/18* (2013.01); *H01Q 15/246* (2013.01); *H01Q 21/005* (2013.01); *H01Q 21/0006* (2013.01); *H01Q 21/245* (2013.01)

(58) Field of Classification Search

CPC ..... H01Q 21/0006; H01Q 21/064; H01Q 21/245; H01Q 15/246; H01Q 13/106; H01Q 13/18

See application file for complete search history.

(56) References Cited

U.S. PATENT DOCUMENTS 4,429,313 A * 1/1984 Muhs, Jr. ..... H01Q 21/005 343/771
4,821,044 A * 4/1989 Kurtz ..... H01Q 21/005 343/771
5,270,721 A * 12/1993 Tsukamoto ..... H01Q 21/0075 343/700 MS (Continued)

*Primary Examiner* — Dameon E Levi
*Assistant Examiner* — Ab Salam Alkassim, Jr.
(74) *Attorney, Agent, or Firm* — JCIPRNET

(57) ABSTRACT

A waveguide slotted array antenna comprises a feed layer and a radiation layer, wherein the feed layer is located below the radiation layer, and the radiation layer comprises a first radiation unit, a second radiation unit, a third radiation unit and a fourth radiation unit which are stacked from bottom to top; the first radiation unit comprises a first flat metal plate and a first radiation array arranged on the first flat metal plate, the second radiation unit comprises a second flat metal plate and a second radiation array arranged on the second flat metal plate, the third radiation unit comprises a third flat metal plate and a third radiation array arranged on the third flat metal plate, and the fourth radiation unit comprises a fourth flat metal plate and a fourth radiation array arranged on the fourth flat metal plate. The waveguide slotted array antenna has the advantages of low sidelobes and low cost while ensuring broad bands and high gains, and can be made small.

4 Claims, 13 Drawing Sheets

(56) References Cited

U.S. PATENT DOCUMENTS 6,028,562 A * 2/2000 Guler ..... H01Q 13/10 343/770
6,285,335 B1 * 9/2001 Snygg ..... H01Q 21/0087 343/770
6,297,774 B1 * 10/2001 Chung ..... H01Q 21/0087 343/700 R
6,535,173 B2 * 3/2003 Ou ..... H01Q 21/005 343/770
6,563,398 B1 * 5/2003 Wu ..... H01Q 21/0037 333/137
7,394,427 B2 * 7/2008 Cho ..... H01Q 21/0087 343/700 MS
8,558,746 B2 * 10/2013 Thomson ..... H01Q 21/0075 29/600
8,618,994 B1 * 12/2013 Harris ..... H01Q 15/24 343/756
9,899,722 B2 * 2/2018 Saraf ..... H01P 5/19
10,236,587 B2 * 3/2019 Kim ..... H01Q 13/06
2002/0101385 A1 * 8/2002 Huor ..... H01Q 21/005 343/770
2004/0080463 A1 * 4/2004 Jeong ..... H01Q 1/523 343/770
2010/0001916 A1 * 1/2010 Yamaguchi ..... H01Q 13/12 343/771
2013/0120205 A1 * 5/2013 Thomson ..... H01Q 21/0075 343/776
2013/0120206 A1 * 5/2013 Biancotto ..... H01Q 21/005 343/776
2014/0254976 A1 * 9/2014 Thomson ..... H01P 1/173 385/11
2015/0188236 A1 * 7/2015 Oppenlaender ..... H01Q 13/02 343/776
2016/0020522 A1 * 1/2016 Sano ..... H01Q 13/10 343/767
2016/0036131 A1 * 2/2016 Kim ..... H01Q 13/18 343/771
2016/0301143 A1 * 10/2016 Cao ..... H01Q 21/0093
2017/0187119 A1 * 6/2017 Kirino ..... H01Q 1/2291
2017/0244173 A1 * 8/2017 Moon ..... H01Q 13/10
2017/0271776 A1 * 9/2017 Biancotto ..... H01Q 21/245
2018/0026378 A1 * 1/2018 Hadavy ..... B21K 23/00 343/771
2018/0219289 A1 * 8/2018 Sherlock ..... H01Q 5/42
2018/0301815 A1 * 10/2018 Kamo ..... G01S 7/03

* cited by examiner

WAVEGUIDE SLOTTED ARRAY ANTENNA

CROSS-REFERENCE TO RELATED APPLICATION

This application claims the priority benefit of China application serial no. 201710429885.0, filed on Jun. 9, 2017. The entirety of the above-mentioned patent application is hereby incorporated by reference herein and made a part of this specification.

BACKGROUND

Technical Field

The invention relates to an array antenna, in particular to a waveguide slotted array antenna.

Description of Related Art

In recent years, high-sensitivity, broadband, low-profile, low sidelobe and high-performance array antennas have the characteristics of multi-frequency band and low cost, and thereby are widely applied to the technical fields such as radar, communication, remote sensing and measuring, spatial technology and the like. Micro-strip array antennas and waveguide slotted array antennas are mainly used at present.

Micro-strip array antennas have the characteristics of being low in profile, low in cost, light, easy to machine, etc.; however, when the frequency or the antenna array scale is increased, the insert loss of the micro-strip array antennas is increased due to the conductor loss and dielectric loss. Therefore, the micro-strip array antennas can achieve broad bands, but cannot achieve high frequency, high efficiency or high gains.

For waveguide slotted array antennas, one or more slots are formed in the conductor wall of a waveguide tube to cut off current lines on the inner wall, part of currents on the surface of the waveguide inner wall can bypass the slots, the other part of the currents flow through the slots in the original direction in the displacement current form, and thus radiation is generated by power lines at the slots. The waveguide slotted array antennas have the characteristics of low conductor loss, high efficiency, stable performance and the like. Existing waveguide slotted array antennas include waveguide slotted traveling wave array antennas and waveguide slotted standing wave array antennas. The beam pointing of the waveguide slotted traveling wave array antennas change along with the frequency, consequentially, the beam pointing of the antennas is inconsistent within a broadband range, the antennas can only be used within an extremely narrow bandwidth range, and the frequency band cannot be widened; as the waveguide slotted standing wave array antennas are essentially resonant antennas, electric performance indexes such as the directional pattern and the sidelobe level can deteriorate severely once the frequency deviates from the resonant frequency, and thus the waveguide slotted standing wave array antennas can be used only within a narrow frequency band range, and the bandwidth is inversely proportional to the array antenna scale.

With the increase of the radar anti-interference requirement and the development of the modern electronic industry, antennas are required to have the performance of low sidelobes or extremely low sidelobes. A traditional waveguide slotted array antenna comprises a feed layer and a radiation layer, and two schemes are mainly used for lowering sidelobes of the traditional waveguide slotted array antenna. For one scheme, energy distribution of the radiation layer is adjusted by adjusting the power distribution proportion of the feed layer, and thus the sidelobes are lowered; however, by adoption of the scheme, the main lobe is generally widened and the gain is reduced while the sidelobes are lowered, and extremely low sidelobes cannot be achieved on the basis of ensuring a narrow main lobe and avoiding the gain loss. For the second scheme, a polarization layer is additionally arranged on the radiation layer to lower sidelobes, specifically, through the polarization layer, the polarization direction of an electric field can deflect in the rotating direction of a metal strip, the energy of a square array antenna in the diagonal direction can well distributed conically, and then the antenna can rotate by 45 degrees around a spindle; through the polarization layer at the angle of 45 degrees, directional patterns of the E plane and the H plane of antennas can be optimized, and low sidelobes achieved; however, during volume production, the cost of antennas can be increased by 20%. In addition, the waveguide wide sides of traditional waveguide slotted array antennas are inversely proportional to the frequency, the wide sides are large under a low frequency, and consequentially small sizes of antennas cannot be ensured; in addition, the machining and welding requirements for feed and radiation array surfaces are high, and consequentially, the machining precision cannot be ensured, and volume production cannot be achieved easily.

SUMMARY

The invention aims to provide a waveguide slotted array antenna which has low sidelobes and low cost while ensuring broad bands and high gains, and can be made small.

According to the technical scheme adopted by the invention for achieving the above aim: the waveguide slotted array antenna comprises a feed layer and a radiation layer, wherein the feed layer is located below the radiation layer, and the radiation layer comprises a first radiation unit, a second radiation unit, a third radiation unit and a fourth radiation unit which are stacked from bottom to top. The first radiation unit comprises a first flat metal plate and a first radiation array arranged on the first flat metal plate; the first radiation array comprises $n^2$ radiation cavities which are arranged at intervals, wherein $n=2^k$, and k is a positive integer which is equal to or greater than two; the radiation cavities are rectangular concave cavities formed in the upper surface of the first flat metal plate, and the $n^2$ radiation cavities are distributed on the first flat metal plate in n rows and n columns; first matching plates are separately arranged in the middle of the front side wall and the middle of the rear side wall of each radiation cavity, and second matching plates are separately arranged in the middle of the left side wall and the middle of the right side wall of each radiation cavity; with the front side wall direction of each radiation cavity as the length direction and the left side wall direction of each radiation cavity as the width direction, the height of each first matching plate and the height of each second matching plate are equal to that of each radiation cavity; the upper end faces of the first matching plates and the upper end faces of the second matching plates are located on the same plane with the upper end face of the first flat metal plate; the length of each first matching plate is not over one fifth of the length of each radiation cavity, and the width of each first matching plate is not over one fifth of the width of each radiation cavity; the length of each second matching plate is not over one fifth of the length of each radiation cavity, and the width of each second matching plate is not over one third of the width of each radiation cavity; an input port extending to the lower surface of the first flat metal plate is arranged at the bottom end of each radiation cavity, and the input ports are rectangular ports; the front side wall of each input port is parallel to the front side wall of the corresponding radiation cavity, the left side wall of each input port is parallel to the left side wall of the corresponding radiation cavity, the center of each input port overlaps with the center of the corresponding radiation cavity, the length of each input port is smaller than the distance between the two corresponding second matching plates, and the width of each input port is smaller than the distance between the two corresponding first matching plates. The second radiation unit comprises a second flat metal plate and a second radiation array arranged on the second flat metal plate; the second radiation array comprises $n^2$ first radiation sets which are arranged at intervals, and the $n^2$ first radiation sets are distributed on the second flat metal plate in n rows and n columns and communicated with the $n^2$ radiation cavities in a one-to-one correspondence mode. Each first radiation set comprises four first radiation holes which are distributed in two rows and two columns at intervals, wherein the first radiation holes are rectangular holes extending from the upper surface to the lower surface of the second flat metal plate, the four first radiation holes in the first radiation set are located over the radiation cavities correspondingly communicated with the four first radiation holes; the front side walls of the two first radiation holes located in the first row are flush with the front side walls of the corresponding radiation cavities, and the rear side walls of the two first radiation holes located in the second row are flush with the rear side walls of the corresponding radiation cavities; the left side walls of the two first radiation holes located in the first column are flush with the left side walls of the corresponding radiation cavities, and the right side walls of the two first radiation holes located in the second column are flush with the right side walls of the corresponding radiation cavities. The third radiation unit comprises a third flat metal plate and a third radiation array arranged on the third flat metal plate; the third radiation array comprises $n^2$ second radiation sets which are arranged at intervals, and the $n^2$ second radiation sets are distributed on the third flat metal plate in n rows and n columns and communicated with the $n^2$ first radiation sets in a one-to-one correspondence mode. Each second radiation set comprises four second radiation holes which are distributed in two rows and two columns at intervals, wherein the second radiation holes are rectangular holes extending from the upper surface to the lower surface of the third flat metal plate, the four second radiation holes in the second radiation set completely overlap with the four first radiation holes in the first radiation set communicated with the second radiation set in a one-to-one correspondence mode after clockwise rotating by 22.5 degrees around the center. The fourth radiation unit comprises a fourth flat metal plate and a fourth radiation array arranged on the fourth flat metal plate; the fourth radiation array comprises $n^2$ third radiation sets which are arranged at intervals, and the $n^2$ third radiation sets are distributed on the fourth flat metal plate in n rows and n columns and communicated with the $n^2$ second radiation sets in a one-to-one correspondence mode. Each third radiation set comprises four third radiation holes which are distributed in two rows and two columns at intervals, wherein the third radiation holes are rectangular holes extending from the upper surface to the lower surface of the fourth flat metal plate, the four third radiation holes in the third radiation set are communicated with the four second radiation holes in the corresponding second radiation set in a one-to-one correspondence mode, and the center of each third radiation hole overlaps with the center of the second radiation hole communicated with the third radiation hole; each third radiation hole can anticlockwise deflect by 22.5 degrees around the center relative to the corresponding second radiation hole; the length of each third radiation hole is greater than that of each second radiation hole and smaller than 1.5 times of the length of each second radiation hole, and the width of each third radiation hole is greater than two times of the width of each second radiation hole and smaller than three times of the width of each second radiation hole. A rectangular metal strip is arranged in each third radiation hole, wherein the left end face of the metal strip is connected with the left side wall of the third radiation hole, and the right end face of the metal strip is connected with the right side wall of the third radiation hole; the distance from the front end face of the metal strip to the front side wall of the third radiation hole is equal to the distance from the rear end face of the metal strip to the rear side wall of the third radiation hole; the upper end face of the metal strip is located on the same plane with the upper end face of the fourth flat metal plate; the height of the metal strip is smaller than that of the third radiation hole, the width of the metal strip is not over one third of the width of third radiation hole, and the length of the metal strip is equal to that of the third radiation hole. The first flat metal plate, the second flat metal plate, the third flat metal plate and the fourth flat metal plate are rectangular plates with equal lengths and widths, and the edges of the four flat metal plates are aligned.

The feed layer comprises $$\left(\frac{n}{2^1}\right)^2$$

H-shaped single ridge waveguide power division networks, two rectangular waveguide-single ridge waveguide converters and an E-plane waveguide power divider. Each H-shaped single ridge waveguide power division network is provided with an input terminal and four output terminals. Each rectangular waveguide-single ridge waveguide converter is provided with a rectangular waveguide input terminal and a single ridge waveguide output terminal. The $$\left(\frac{n}{2^1}\right)^2$$

H-shaped single ridge waveguide power division networks are evenly distributed to form a first-level feed network array including $$\frac{n}{2^1}$$

rows and $$\frac{n}{2^1}$$

columns, and the H-shaped single ridge waveguide power division networks in every two rows and two columns of the first-level feed network array form a first-level H-shaped single ridge waveguide power division network unit, and the first-level feed network array includes $$\frac{\left(\frac{n}{2^1}\right)^2}{4}$$

first-level H-shaped single ridge waveguide power division network units; the input terminals of the four H-shaped single ridge waveguide power division networks in each first-level H-shaped single ridge waveguide power division network unit are connected through one H-shaped single ridge waveguide power division network; the H-shaped single ridge waveguide power division networks through which the input terminals of the four H-shaped single ridge waveguide power division networks in each of the $$\frac{\left(\frac{n}{2^1}\right)^2}{4}$$

first-level H-shaped single ridge waveguide power division network units are connected form a second-level feed network array including $$\frac{n}{2^2}$$

rows and $$\frac{n}{2^2}$$

columns, the H-shaped single ridge waveguide power division networks in every two rows and two columns of the second-level feed network array form a second-level H-shaped single ridge waveguide power division network unit, the second-level feed network array includes $$\frac{\left(\frac{n}{2^1}\right)^2}{4^2}$$

second-level H-shaped single ridge waveguide power division network units, and the input terminals of the four H-shaped single ridge waveguide power division networks in each second-level H-shaped single ridge waveguide power division network unit are connected through one H-shaped single ridge waveguide power division network; by this by analogy, a (k−1)th-level H-shaped single ridge waveguide power division network unit including only four H-shaped single ridge waveguide power division networks is finally formed, and the input terminals of the four H-shaped single ridge waveguide power division networks in the (k−1)th-level H-shaped single ridge waveguide power division network unit are also connected through one H-shaped single ridge waveguide power division network; the single ridge waveguide output terminals of the two rectangular waveguide-single ridge waveguide converters are both connected with the input terminal of the H-shaped single ridge waveguide power division network through which the four H-shaped single ridge waveguide power division networks in the (k−1)th-level H-shaped single ridge waveguide power division network unit are connected, the rectangular waveguide input terminals of the two rectangular waveguide-single ridge waveguide converters are both connected with the output terminal of the E-plane waveguide power divider, and the input terminal of the E-plane waveguide power divider serves as the input terminal of the array antenna; the four output terminals of each H-shaped single ridge waveguide power division network in the first-level feed network array are provided with single ridge waveguide-rectangular waveguide converters respectively, and the $n^2$ single ridge waveguide-rectangular waveguide converters are connected with the $n^2$ input ports in the first radiation unit in a one-to-one correspondence mode. In the structure, the feed layer is of an input-output unidirectional structure by means of an H-shaped single ridge rectangular waveguide power divider, the structure is compact, the cut-off frequency can be reduced, the dominant-mode bandwidth is widened, and ultra-wideband and high-efficiency feed of the array antenna is achieved; under a given frequency, the sizes of wide sides can be reduced through H-shaped single ridge rectangular waveguides, the weight of the antenna is reduced, and the antenna can be made small.

Each rectangular waveguide-single ridge waveguide converter comprises a first rectangular metal block, wherein a rectangular waveguide input port and a first rectangular cavity are sequentially formed in the first rectangular metal block from front to back; the rectangular waveguide input port is formed in the lower end face of the first rectangular metal block, the vertical central line of the first rectangular metal block coincides with the central axis of the rectangular waveguide input port after anticlockwise rotating by 45 degrees, the rectangular waveguide input port is communicated with the first rectangular cavity, and the length of the rectangular waveguide input port is equal to that of the first rectangular cavity; a first E-plane step and a second E-plane step are arranged in the first rectangular cavity and located over the rectangular waveguide input port; the upper end face of the first E-plane step is located on the same plane with the upper side wall of the first rectangular cavity, the lower end face of the first E-plane step is connected with the upper end face of the second E-plane step in an attached mode, the front end face of the first E-plane step is connected with the front side wall of the first rectangular cavity, and the rear end face of the first E-plane step is connected with the rear side wall of the first rectangular cavity; the front end face of the second E-plane step is connected with the front side wall of the first rectangular cavity, and the rear end face of the second E-plane step is connected with the rear side wall of the first rectangular cavity; the width of the first E-plane step is smaller than that of the rectangular waveguide input port, the width of the second E-plane step is smaller than that of the first E-plane step, and the length of the first E-plane step is equal to that of the second E-plane step and also equal to that of the rectangular waveguide input port; a first H-plane step is arranged on the right side of the first rectangular cavity and connected with the right side wall and the front side wall of the first rectangular cavity, and the height of the first H-plane step is equal to that of the first rectangular cavity; a single ridge waveguide output port extending to the first rectangular cavity is formed in the rear end face of the first rectangular metal block, and the single ridge waveguide output port is rectangular; the vertical central line of the rectangular waveguide input port coincides with the central axis of the single ridge waveguide output port after anticlockwise rotating by 135 degrees, and the single ridge waveguide output port is communicated with the first rectangular cavity; the height of the single ridge waveguide output port is equal to that of the first rectangular cavity, and the width of the single ridge waveguide output port is smaller than that of the first rectangular cavity; a first ridge stair extending into the first rectangular cavity is arranged at the center of the bottom of the single ridge waveguide output port and comprises a first ridge step and a second ridge step which are connected in sequence, the first ridge step and the second ridge step are both rectangular, the front end face of the first ridge step is located in the first rectangular cavity, the front end face of the second ridge step is connected with the rear end face of the first ridge step in an attached mode, and the rear end face of the second ridge step is flush with the rear end face of the first rectangular metal block; the height of the second ridge step is smaller than that of the single ridge waveguide output port, and the height of the first ridge step is smaller than that of the second ridge step. In the structure, by adoption of single ridge waveguides, the structural size of the antenna can be reduced, and an input port of the antenna can be directly rotated by 45 degrees; meanwhile, the incidence angle of the rectangular waveguide input port relative to the first rectangular metal block is 45 degrees, so that a complex input conversion method is not needed, and the input complexity and the overall structural complexity of the antenna are lowered; the first rectangular cavity, the first E-plane step, the second E-plane step, the first H-plane step, the first ridge step and the second ridge step are used for impedance matching, so that the return loss caused by structural discontinuity is reduced, and the structure has a good broadband transmission characteristic.

Each single ridge waveguide-rectangular waveguide converter comprises a second rectangular metal block, a second rectangular cavity is formed in the second rectangular metal block, and a third E-plane step and a fourth E-plane step are arranged on the left side of the second rectangular cavity; the height of the third E-plane step is smaller than that of the second rectangular cavity, and the third E-plane step is connected with the front side wall, the rear side wall and the left side wall of the second rectangular cavity; the fourth E-plane step is located on the third E-plane step, the lower surface of the fourth E-plane step is connected with the upper surface of the third E-plane step in an attached mode, the width of the fourth E-plane step is smaller than that of the third E-plane step, and the fourth E-plane step is connected with the front side wall, the rear side wall and the left side wall of the second rectangular cavity; a second H-plane step is arranged on the right side of the second rectangular cavity and connected with the right side wall and the rear side wall of the second rectangular cavity, and the height of the second H-plane step is equal to that of the second rectangular cavity; a rectangular waveguide output port communicated with the second rectangular cavity is formed in the upper surface of the second rectangular metal block, a single ridge waveguide input port is formed in the front side face of the second rectangular metal block and communicated with the second rectangular cavity, the height of the single ridge waveguide input port is equal to that of the second rectangular cavity, and the bottom surface of the single ridge waveguide input port is located on the same plane with the bottom surface of the second rectangular cavity; a second ridge stair extending onto the bottom surface of the second rectangular cavity is arranged on the bottom surface of the single ridge waveguide input port and comprises a third ridge step and a fourth ridge step, and the height of the third ridge step is greater than that of the fourth ridge step and smaller than that of the second rectangular cavity. In the structure, the single ridge waveguide-rectangular waveguide converter is provided with the second ridge stair at the joint of a single ridge waveguide and a rectangular waveguide, the second H-plane step which is as high as the rectangular waveguide is arranged at the H-plane corner of the rectangular waveguide, the third E-plane step and the fourth E-plane step are arranged at the E-plane corner of the rectangular waveguide, and the second ridge stair, the third E-plane step, the fourth E-plane step and the second H-plane step are used for impedance matching, so that the return loss caused by structural discontinuity is reduced, and the structure has a good broadband transmission characteristic.

Compared with the prior art, the waveguide slotted array antenna of the invention has the advantages that the radiation layer is composed of the first radiation unit, the second radiation unit, the third radiation unit and the fourth radiation unit; the first radiation unit comprises the first flat metal plate and the first radiation array arranged on the first flat metal plate. The first radiation array comprises $n^2$ radiation cavities which are arranged at intervals, wherein $n=2^k$, and k is a positive integer which is equal to or greater than two; the radiation cavities are rectangular concave cavities formed in the upper surface of the first flat metal plate, and the $n^2$ radiation cavities are distributed on the first flat metal plate in n rows and n columns; the first matching plates are separately arranged in the middle of the front side wall and the middle of the rear side wall of each radiation cavity, and the second matching plates are separately arranged in the middle of the left side wall and the middle of the right side wall of each radiation cavity; with the front side wall direction of each radiation cavity as the length direction and the left side wall direction of each radiation cavity as the width direction, the height of each first matching plate and the height of each second matching plate are equal to that of each radiation cavity; the upper end faces of the first matching plates and the upper end faces of the second matching plates are located on the same plane with the upper end face of the first flat metal plate; the length of each first matching plate is not over one fifth of the length of each radiation cavity, and the width of each first matching plate is not over one fifth of the width of each radiation cavity; the length of each second matching plate is not over one fifth of the length of each radiation cavity, and the width of each second matching plate is not over one third of the width of each radiation cavity; one input port extending to the lower surface of the first flat metal plate is arranged at the bottom end of each radiation cavity, and the input ports are rectangular ports; the front side wall of each input port is parallel to the front side wall of the corresponding radiation cavity, the left side wall of each input port is parallel to the left side wall of the corresponding radiation cavity, the center of each input port overlaps with the center of the corresponding radiation cavity, the length of each input port is smaller than the distance between the two corresponding second matching plates, and the width of each input port is smaller than the distance between the two corresponding first matching plates. The second radiation unit comprises the second flat metal plate and the second radiation array arranged on the second flat metal plate; the second radiation array comprises $n^2$ first radiation sets which are arranged at intervals, and the $n^2$ first radiation sets are distributed on the second flat metal plate in n rows and n columns and communicated with the $n^2$ radiation cavities in a one-to-one correspondence mode. Each first radiation set comprises four first radiation holes which are distributed in two rows and two columns at intervals, wherein the first radiation holes are rectangular holes extending from the upper surface to the lower surface of the second flat metal plate, the four first radiation holes in the first radiation set are located over the radiation cavities correspondingly communicated with the four first radiation holes; the front side walls of the two first radiation holes located in the first row are flush with the front side walls of the corresponding radiation cavities, and the rear side walls of the two first radiation holes located in the second row are flush with the rear side walls of the corresponding radiation cavities; the left side walls of the two first radiation holes located in the first column are flush with the left side walls of the corresponding radiation cavities, and the right side walls of the two first radiation holes located in the second column are flush with the right side walls of the corresponding radiation cavities. The third radiation unit comprises the third flat metal plate and the third radiation array arranged on the third flat metal plate; the third radiation array comprises $n^2$ second radiation sets which are arranged at intervals, and the $n^2$ second radiation sets are distributed on the third flat metal plate in n rows and n columns and communicated with the $n^2$ first radiation sets in a one-to-one correspondence mode. Each second radiation set comprises four second radiation holes which are distributed in two rows and two columns at intervals, wherein the second radiation holes are rectangular holes extending from the upper surface to the lower surface of the third flat metal plate, the four second radiation holes in the second radiation set completely overlap with the four first radiation holes in the first radiation set communicated with the second radiation set in a one-to-one correspondence mode after clockwise rotating by 22.5 degrees around the center. The fourth radiation unit comprises the fourth flat metal plate and the fourth radiation array arranged on the fourth flat metal plate; the fourth radiation array comprises $n^2$ third radiation sets which are arranged at intervals, and the $n^2$ third radiation sets are distributed on the fourth flat metal plate in n rows and n columns and communicated with the $n^2$ second radiation sets in a one-to-one correspondence mode. Each third radiation set comprises four third radiation holes which are distributed in two rows and two columns at intervals, wherein the third radiation holes are rectangular holes extending from the upper surface to the lower surface of the fourth flat metal plate, the four third radiation holes in the third radiation set are communicated with the four second radiation holes in the corresponding second radiation set in a one-to-one correspondence mode, and the center of each third radiation hole overlaps with the center of the second radiation hole communicated with the third radiation hole; each third radiation hole can anticlockwise deflect by 22.5 degrees around the center relative to the corresponding second radiation hole; the length of each third radiation hole is greater than that of each second radiation hole and smaller than 1.5 times of the length of each second radiation hole, and the width of each third radiation hole is greater than two times of the width of each second radiation hole and smaller than three times of the width of each second radiation hole. One rectangular metal strip is arranged in each third radiation hole, wherein the left end face of the metal strip is connected with the left side wall of the third radiation hole, and the right end face of the metal strip is connected with the right side wall of the third radiation hole; the distance from the front end face of the metal strip to the front side wall of the third radiation hole is equal to the distance from the rear end face of the metal strip to the rear side wall of the third radiation hole; the upper end face of the metal strip is located on the same plane with the upper end face of the fourth flat metal plate; the height of the metal strip is smaller than that of the third radiation hole, the width of the metal strip is not over one third of the width of third radiation hole, and the length of the metal strip is equal to that of the third radiation hole. The first flat metal plate, the second flat metal plate, the third flat metal plate and the fourth flat metal plate are rectangular plates with equal lengths and widths, and the edges of the four flat metal plates are aligned. Through the cooperation of the radiation cavities, the first radiation holes, the second radiation holes and the third radiation holes, a polarization layer is omitted, and high gains and extremely low sidelobes are obtained under the broadband transmission condition; the first radiation unit, the second radiation unit, the third radiation unit and the fourth radiation unit are arranged layer by layer so that signal leakage can be prevented, machining and assembling requirements are lowered, higher precision can be achieved easily, and low-profile and miniaturization design can be achieved; by adoption of the machining method, the antenna is easy to mount and portable, and meanwhile, the cost is reduced, and the antenna is suitable for volume production.

BRIEF DESCRIPTION OF THE DRAWINGS

FIG. 5(*b*) is a structural diagram of radiation cavities of the first radiation unit of the waveguide slotted array antenna of the invention.

FIG. 11(*b*) is a second structural diagram of the rectangular waveguide-single ridge waveguide converter of the waveguide slotted array antenna of the invention.

DESCRIPTION OF THE EMBODIMENTS

Figure 1:
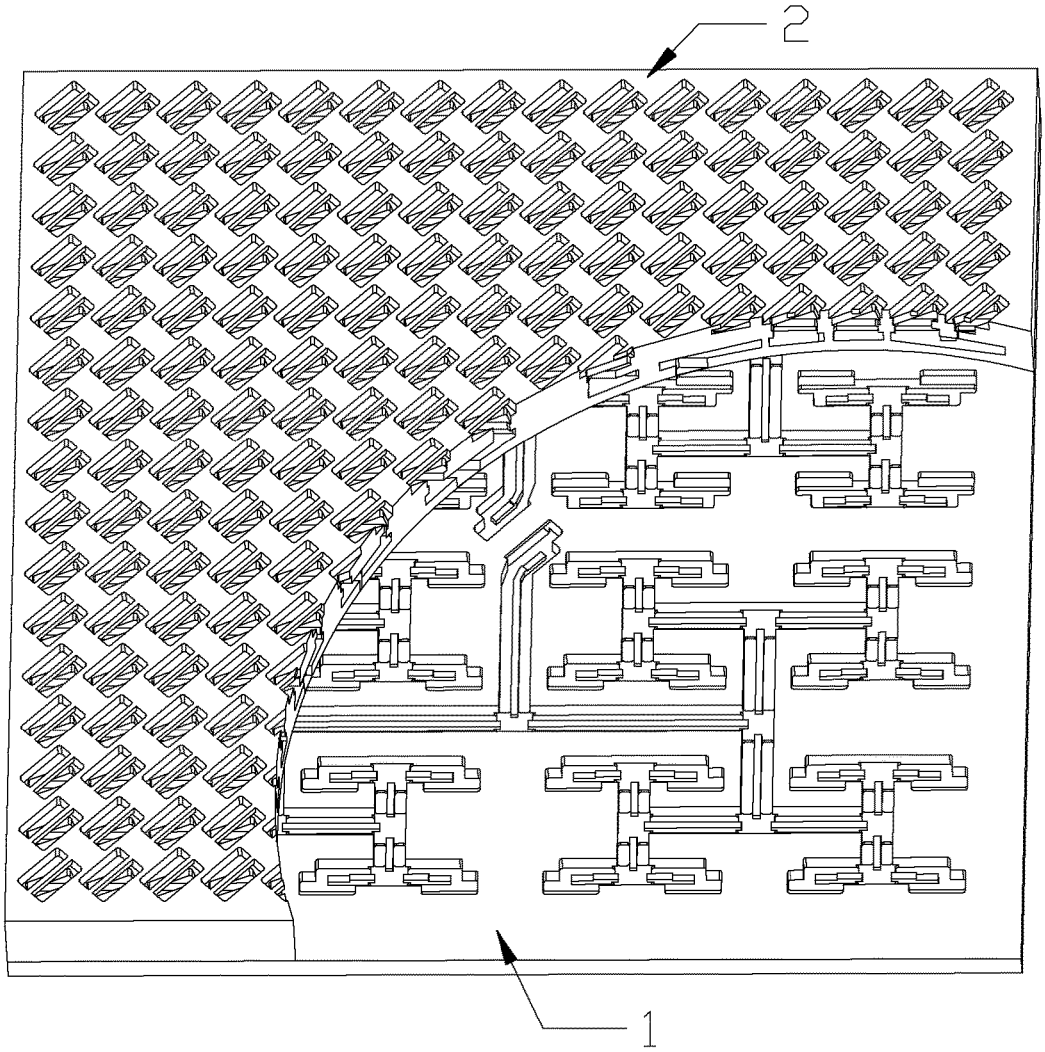
FIG. 1 is a part sectional view of a waveguide slotted array antenna of the invention.
Figure 2:
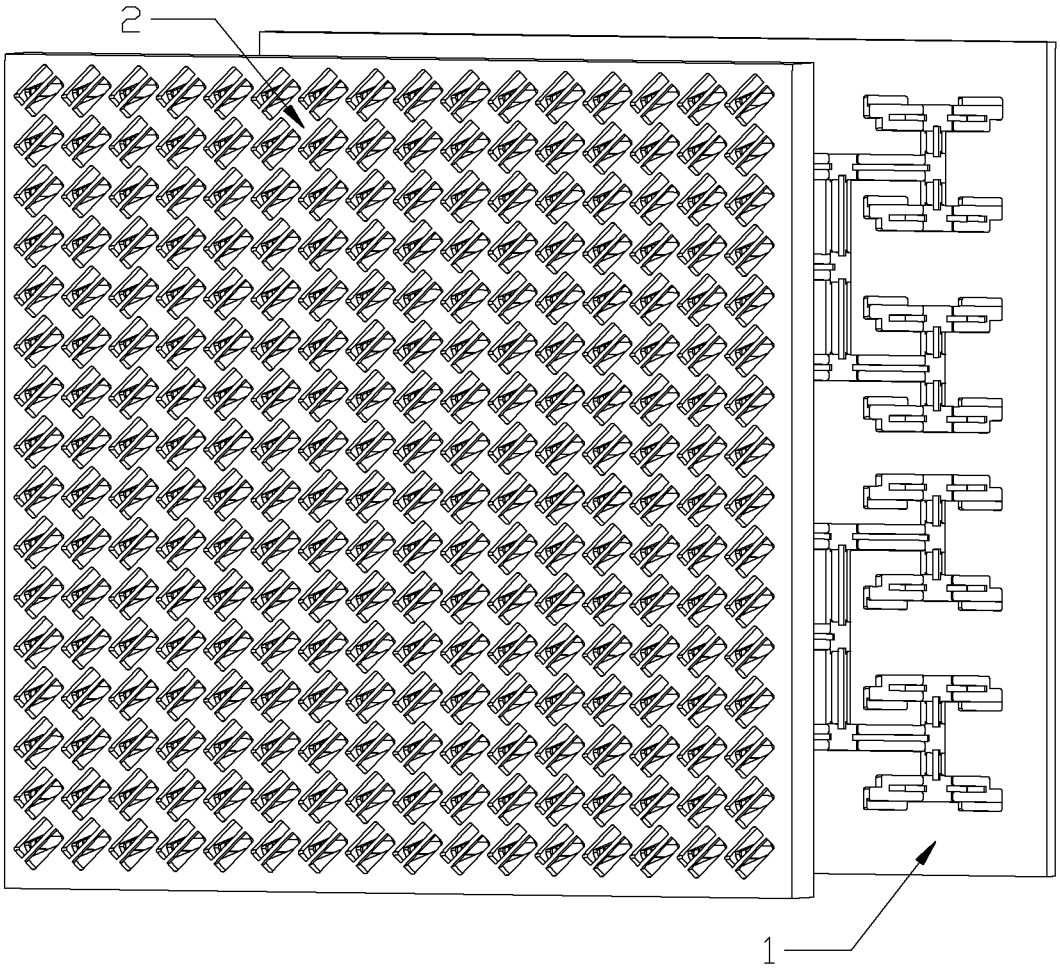
FIG. 2 is a first exploded view of the waveguide slotted array antenna of the invention.
Figure 3:
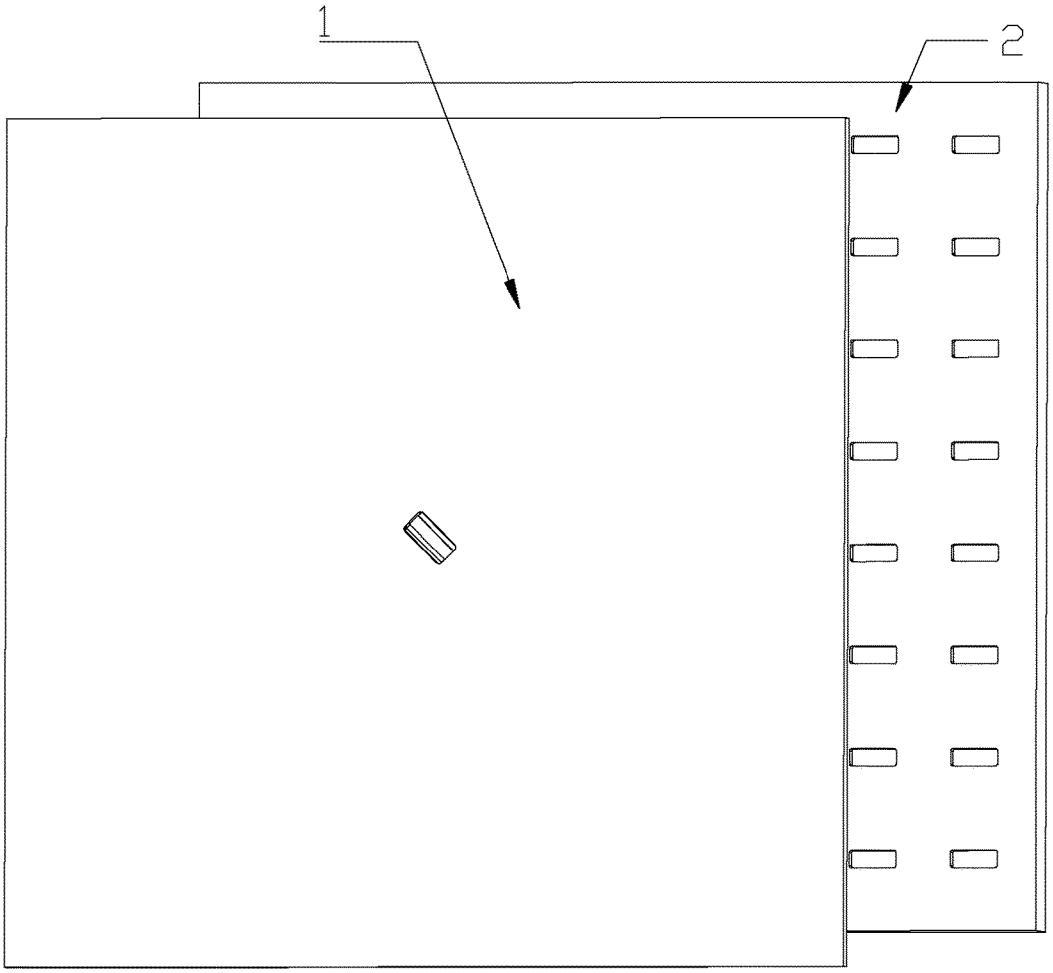
FIG. 3 is a second exploded view of the waveguide slotted array antenna of the invention.
Figure 4:
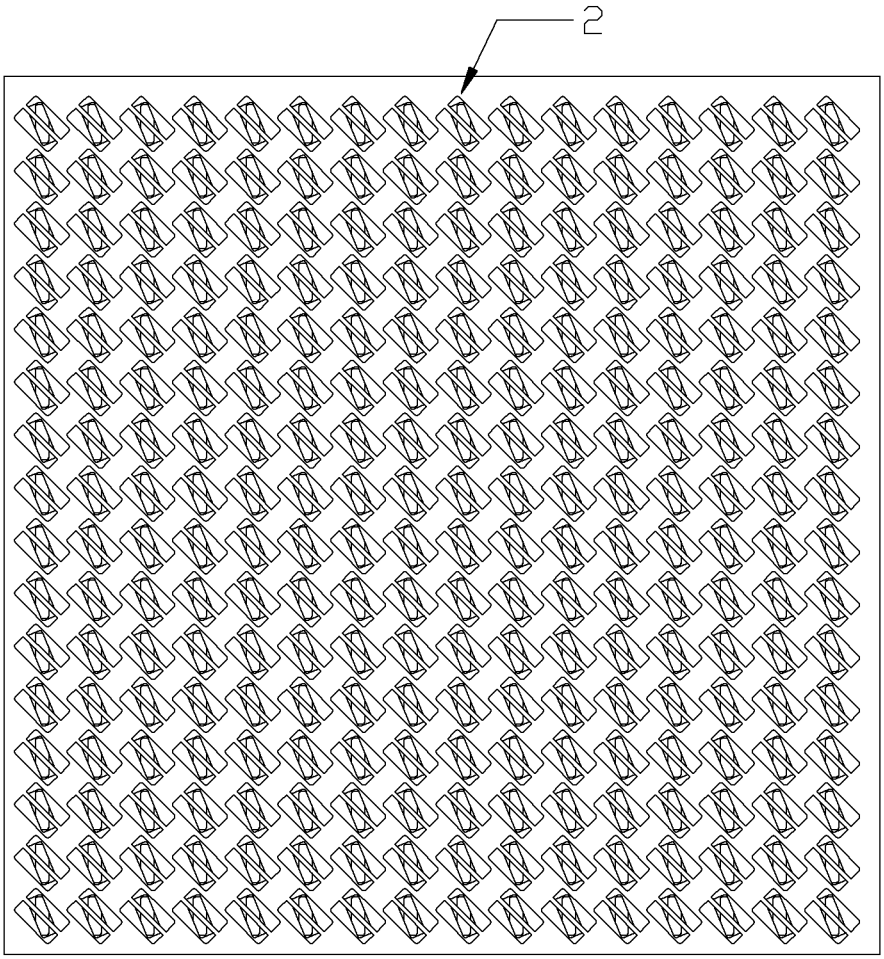
FIG. 4 is a structural diagram of a radiation layer of the waveguide slotted array antenna of the invention.
Figure 5:
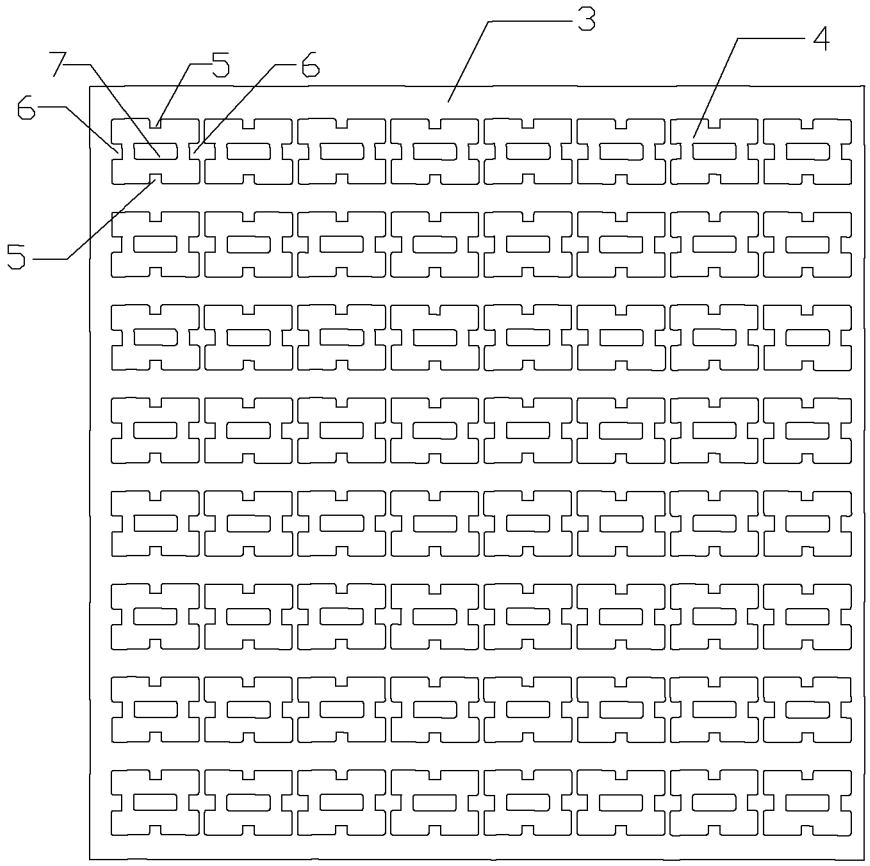
FIG. 5(*a*) is a structural diagram of a first radiation unit of the waveguide slotted array antenna of the invention.
Figure 5:
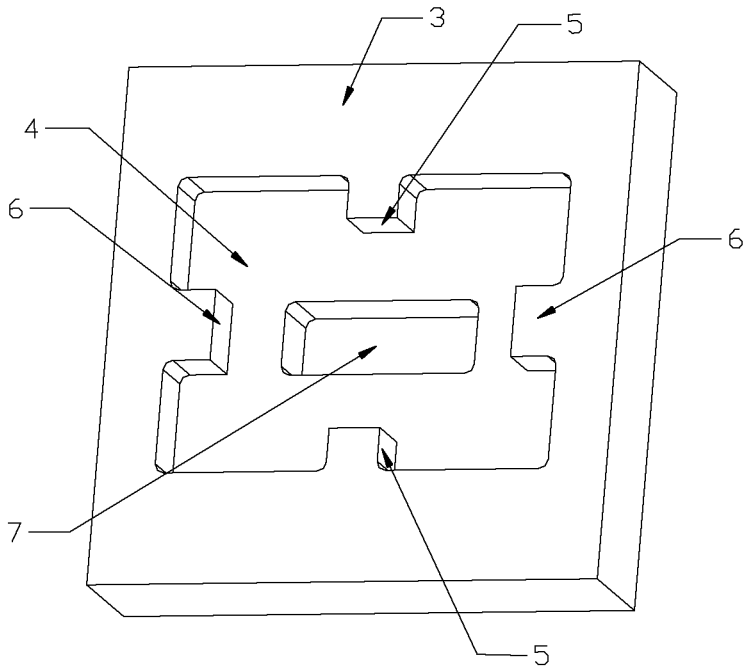
Figure 6:
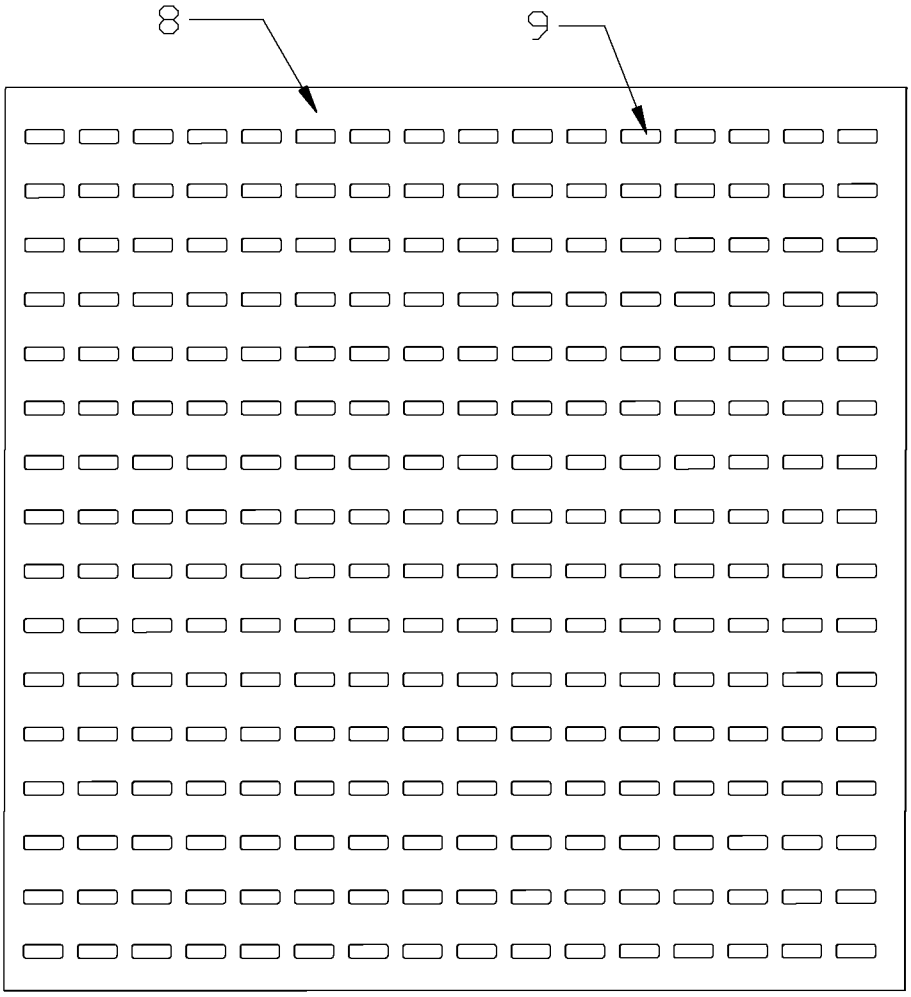
FIG. 6 is a structural diagram of a second radiation unit of the waveguide slotted array antenna of the invention.
Figure 7:
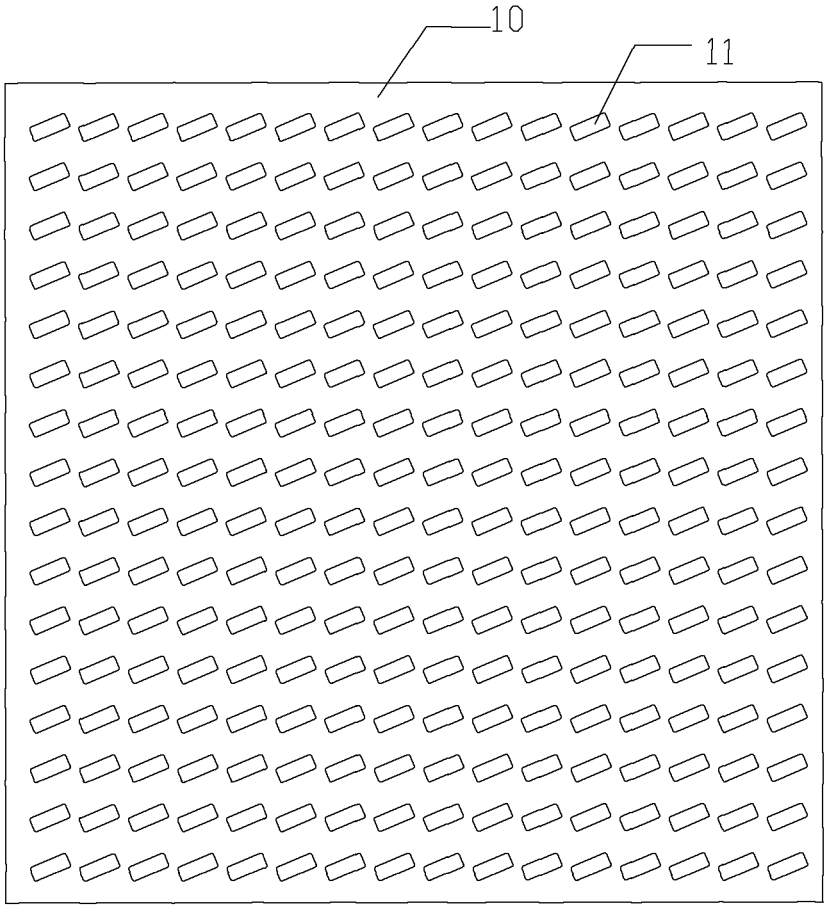
FIG. 7 is a structural diagram of a third radiation unit of the waveguide slotted array antenna of the invention.
Figure 8:
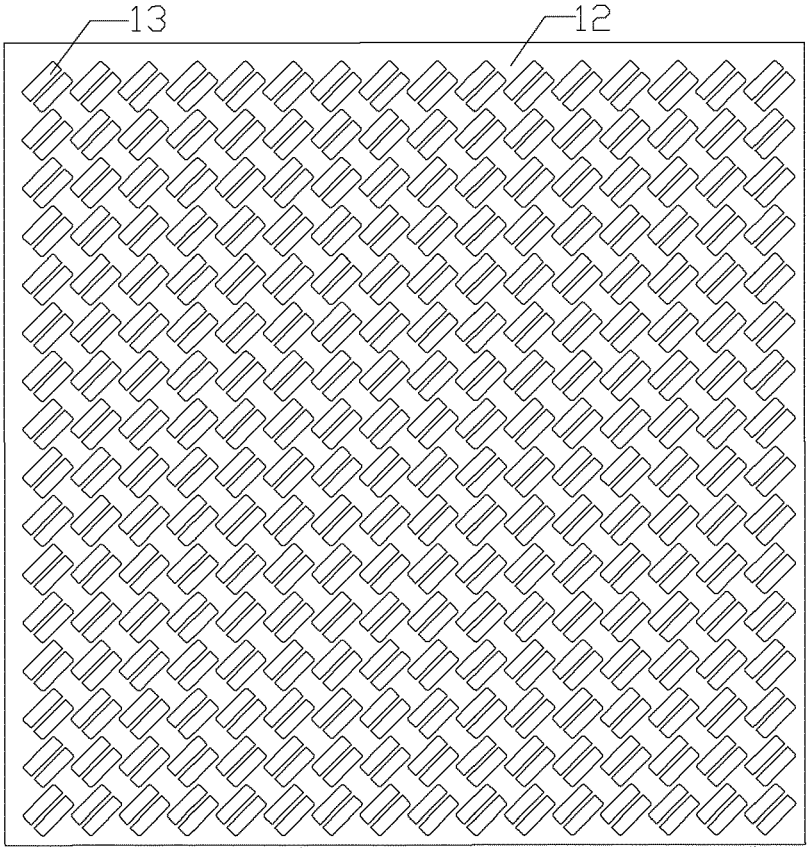
FIG. 8 is a structural diagram of a fourth radiation unit of the waveguide slotted array antenna of the invention.
Figure 9:
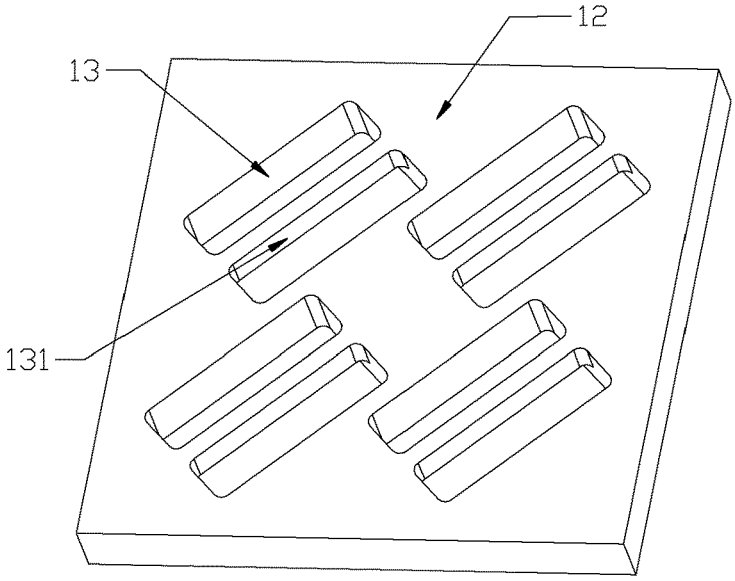
FIG. 9 is a structural diagram of third radiation holes in the fourth radiation unit of the waveguide slotted array antenna of the invention.

A further detailed description of the invention is given with the accompanying drawings as follows.

First Embodiment: as is shown in FIGS. 1-9, a waveguide slotted array antenna comprises a feed layer 1 and a radiation layer 2, wherein the feed layer 1 is located below the radiation layer 2, and the radiation layer 2 comprises a first radiation unit, a second radiation unit, a third radiation unit and a fourth radiation unit which are stacked from bottom to top.

The first radiation unit comprises a first flat metal plate 3 and a first radiation array arranged on the first flat metal plate 3; the first radiation array comprises $n^2$ radiation cavities 4 which are arranged at intervals, wherein $n=2^k$, and k is a positive integer which is equal to or greater than two; the radiation cavities 4 are rectangular concave cavities formed in the upper surface of the first flat metal plate 3, and the $n^2$ radiation cavities 4 are distributed on the first flat metal plate 3 in n columns and n rows; first matching plates 5 are separately arranged in the middle of the front side wall and the middle of the rear side wall of each radiation cavity 4, and second matching plates 6 are separately arranged in the middle of the left side wall and the middle of the right side wall of each radiation cavity 4; with the front side wall direction of each radiation cavity 4 as the length direction and the left side wall direction of each radiation cavity 4 as the width direction, the height of each first matching plate 5 and the height of each second matching plate 6 are equal to that of each radiation cavity 4; the upper end faces of the first matching plates 5 and the upper end faces of the second matching plates 6 are located on the same plane with the upper end face of the first flat metal plate 3; the length of each first matching plate 5 is not over one fifth of the length of each radiation cavity 4, and the width of each first matching plate 5 is not over one fifth of the width of each radiation cavity 4; the length of each second matching plate 6 is not over one fifth of the length of each radiation cavity 4, and the width of each second matching plate 5 is not over one third of the width of each radiation cavity 4; an input port 7 extending to the lower surface of the first flat metal plate 3 is arranged at the bottom end of each radiation cavity 4, and the input ports 7 are rectangular ports; the front side wall of each input port 7 is parallel to the front side wall of the corresponding radiation cavity 4, the left side wall of each input port 7 is parallel to the left side wall of the corresponding radiation cavity 4, the center of each input port 7 overlaps with the center of the corresponding radiation cavity 4, the length of each input port 7 is smaller than the distance between the two corresponding second matching plates 6, and the width of each input port 7 is smaller than the distance between the two corresponding first matching plates 5.

The second radiation unit comprises a second flat metal plate 8 and a second radiation array arranged on the second flat metal plate 8; the second radiation array comprises $n^2$ first radiation sets which are arranged at intervals, and the $n^2$ first radiation sets are distributed on the second flat metal plate 8 in n rows and n columns and communicated with the $n^2$ radiation cavities 4 in a one-to-one correspondence mode.

Each first radiation set comprises four first radiation holes 9 which are distributed in two rows and two columns at intervals, wherein the first radiation holes 9 are rectangular holes extending from the upper surface to the lower surface of the second flat metal plate 8, the four first radiation holes 9 in the first radiation set are located over the radiation cavities 4 correspondingly communicated with the four first radiation holes 9; the front side walls of the two first radiation holes 9 located in the first row are flush with the front side walls of the corresponding radiation cavities 4, and the rear side walls of the two first radiation holes 9 located in the second row are flush with the rear side walls of the corresponding radiation cavities 4; the left side walls of the two first radiation holes 9 located in the first column are flush with the left side walls of the corresponding radiation cavities 4, and the right side walls of the two first radiation holes 9 located in the second column are flush with the right side walls of the corresponding radiation cavities 4.

The third radiation unit comprises a third flat metal plate 10 and a third radiation array arranged on the third flat metal plate 10; the third radiation array comprises $n^2$ second radiation sets which are arranged at intervals, and the $n^2$ second radiation sets are distributed on the third flat metal plate 10 in n rows and n columns and communicated with the $n^2$ first radiation sets in a one-to-one correspondence mode.

Each second radiation set comprises four second radiation holes 11 which are distributed in two rows and two columns at intervals, wherein the second radiation holes 11 are rectangular holes extending from the upper surface to the lower surface of the third flat metal plate 10, the four second radiation holes 11 in the second radiation set completely overlap with the four first radiation holes 9 in the first radiation set communicated with the second radiation set in a one-to-one correspondence mode after clockwise rotating by 22.5 degrees around the center.

The fourth radiation unit comprises a fourth flat metal plate 12 and a fourth radiation array arranged on the fourth flat metal plate 12; the fourth radiation array comprises $n^2$ third radiation sets which are arranged at intervals, and the $n^2$ third radiation sets are distributed on the fourth flat metal plate 12 in n rows and n columns and communicated with the $n^2$ second radiation sets in a one-to-one correspondence mode.

Each third radiation set comprises four third radiation holes 13 which are distributed in two rows and two columns at intervals, wherein the third radiation holes 13 are rectangular holes extending from the upper surface to the lower surface of the fourth flat metal plate 12, the four third radiation holes 13 in the third radiation set are communicated with the four second radiation holes 11 in the corresponding second radiation set in a one-to-one correspondence mode, and the center of each third radiation hole 13 overlaps with the center of the second radiation hole 11 communicated with the third radiation hole 13; each third radiation hole 13 can anticlockwise deflect by 22.5 degrees around the center relative to the corresponding second radiation hole 11; the length of each third radiation hole 13 is greater than the length of each second radiation hole 11 and smaller than 1.5 times of the length of each second radiation hole 11, and the width of each third radiation hole 13 is greater than two times of the width of each second radiation hole 11 and smaller than three times of the width of each second radiation hole 11.

A rectangular metal strip 131 is arranged in each third radiation hole 13, wherein the left end face of the metal strip 131 is connected with the left side wall of the third radiation hole 13, and the right end face of the metal strip 131 is connected with the right side wall of the third radiation hole 13; the distance from the front end face of the metal strip to the front side wall of the third radiation hole 13 is equal to the distance from the rear end face of the metal strip to the rear side wall of the third radiation hole 13; the upper end face of the metal strip is located on the same plane with the upper end face of the fourth flat metal plate 12; the height of the metal strip is smaller than that of the third radiation hole 13, the width of the metal strip is not over one third of the width of third radiation hole 13, and the length of the metal strip is equal to that of the third radiation hole 13.

The first flat metal plate 3, the second flat metal plate 8, the third flat metal plate 10 and the fourth flat metal plate 12 are rectangular plates with equal lengths and widths, and the edges of the four flat metal plates are aligned.

Second Embodiment: as is shown in FIGS. 1-9, a waveguide slotted array antenna comprises a feed layer 1 and a radiation layer 2, wherein the feed layer 1 is located below the radiation layer 2, and the radiation layer 2 comprises a first radiation unit, a second radiation unit, a third radiation unit and a fourth radiation unit which are stacked from bottom to top.

The first radiation unit comprises a first flat metal plate 3 and a first radiation array arranged on the first flat metal plate 3; the first radiation array comprises $n^2$ radiation cavities 4 which are arranged at intervals, wherein $n=2^k$, and k is a positive integer which is equal to or greater than two; the radiation cavities 4 are rectangular concave cavities formed in the upper surface of the first flat metal plate 3, and the $n^2$ radiation cavities 4 are distributed on the first flat metal plate 3 in n columns and n rows; first matching plates 5 are separately arranged in the middle of the front side wall and the middle of the rear side wall of each radiation cavity 4, and second matching plates 6 are separately arranged in the middle of the left side wall and the middle of the right side wall of each radiation cavity 4; with the front side wall direction of each radiation cavity 4 as the length direction and the left side wall direction of each radiation cavity 4 as the width direction, the height of each first matching plate 5 and the height of each second matching plate 6 are equal to that of each radiation cavity 4; the upper end faces of the first matching plates 5 and the upper end faces of the second matching plates 6 are located on the same plane with the upper end face of the first flat metal plate 3; the length of each first matching plate 5 is not over one fifth of the length of each radiation cavity 4, and the width of each first matching plate 5 is not over one fifth of the width of each radiation cavity 4; the length of each second matching plate 6 is not over one fifth of the length of each radiation cavity 4, and the width of each second matching plate 5 is not over one third of the width of each radiation cavity 4; an input port 7 extending to the lower surface of the first flat metal plate 3 is arranged at the bottom end of each radiation cavity 4, and the input ports 7 are rectangular ports; the front side wall of each input port 7 is parallel to the front side wall of the corresponding radiation cavity 4, the left side wall of each input port 7 is parallel to the left side wall of the corresponding radiation cavity 4, the center of each input port 7 overlaps with the center of the corresponding radiation cavity 4, the length of each input port 7 is smaller than the distance between the two corresponding second matching plates 6, and the width of each input port 7 is smaller than the distance between the two corresponding first matching plates 5.

The second radiation unit comprises a second flat metal plate 8 and a second radiation array arranged on the second flat metal plate 8; the second radiation array comprises $n^2$ first radiation sets which are arranged at intervals, and the $n^2$ first radiation sets are distributed on the second flat metal plate 8 in n rows and n columns and communicated with the $n^2$ radiation cavities 4 in a one-to-one correspondence mode.

Each first radiation set comprises four first radiation holes 9 which are distributed in two rows and two columns at intervals, wherein the first radiation holes 9 are rectangular holes extending from the upper surface to the lower surface of the second flat metal plate 8, the four first radiation holes 9 in the first radiation set are located over the radiation cavities 4 correspondingly communicated with the four first radiation holes 9; the front side walls of the two first radiation holes 9 located in the first row are flush with the front side walls of the corresponding radiation cavities 4, and the rear side walls of the two first radiation holes 9 located in the second row are flush with the rear side walls of the corresponding radiation cavities 4; the left side walls of the two first radiation holes 9 located in the first column are flush with the left side walls of the corresponding radiation cavities 4, and the right side walls of the two first radiation holes 9 located in the second column are flush with the right side walls of the corresponding radiation cavities 4.

The third radiation unit comprises a third flat metal plate 10 and a third radiation array arranged on the third flat metal plate 10; the third radiation array comprises $n^2$ second radiation sets which are arranged at intervals, and the $n^2$ second radiation sets are distributed on the third flat metal plate 10 in n rows and n columns and communicated with the $n^2$ first radiation sets in a one-to-one correspondence mode.

Each second radiation set comprises four second radiation holes 11 which are distributed in two rows and two columns at intervals, wherein the second radiation holes 11 are rectangular holes extending from the upper surface to the lower surface of the third flat metal plate 10, the four second radiation holes 11 in the second radiation set completely overlap with the four first radiation holes 9 in the first radiation set communicated with the second radiation set in a one-to-one correspondence mode after clockwise rotating by 22.5 degrees around the center.

The fourth radiation unit comprises a fourth flat metal plate 12 and a fourth radiation array arranged on the fourth flat metal plate 12; the fourth radiation array comprises $n^2$ third radiation sets which are arranged at intervals, and the $n^2$ third radiation sets are distributed on the fourth flat metal plate 12 in n rows and n columns and communicated with the $n^2$ second radiation sets in a one-to-one correspondence mode.

Each third radiation set comprises four third radiation holes 13 which are distributed in two rows and two columns at intervals, wherein the third radiation holes 13 are rectangular holes extending from the upper surface to the lower surface of the fourth flat metal plate 12, the four third radiation holes 13 in the third radiation set are communicated with the four second radiation holes 11 in the corresponding second radiation set in a one-to-one correspondence mode, and the center of each third radiation hole 13 overlaps with the center of the second radiation hole 11 communicated with the third radiation hole 13; each third radiation hole 13 can anticlockwise deflect by 22.5 degrees around the center relative to the corresponding second radiation hole 11; the length of each third radiation hole 13 is greater than the length of each second radiation hole 11 and smaller than 1.5 times of the length of each second radiation hole 11, and the width of each third radiation hole 13 is greater than two times of the width of each second radiation hole 11 and smaller than three times of the width of each second radiation hole 11.

A rectangular metal strip is arranged in each third radiation hole 13, wherein the left end face of the metal strip is connected with the left side wall of the third radiation hole 13, and the right end face of the metal strip is connected with the right side wall of the third radiation hole 13; the distance from the front end face of the metal strip to the front side wall of the third radiation hole 13 is equal to the distance from the rear end face of the metal strip to the rear side wall of the third radiation hole 13; the upper end face of the metal strip is located on the same plane with the upper end face of the fourth flat metal plate 12; the height of the metal strip is smaller than that of the third radiation hole 13, the width of the metal strip is not over one third of the width of third radiation hole 13, and the length of the metal strip is equal to that of the third radiation hole 13.

The first flat metal plate 3, the second flat metal plate 8, the third flat metal plate 10 and the fourth flat metal plate 12 are rectangular plates with equal lengths and widths, and the edges of the four flat metal plates are aligned.

Figure 10:
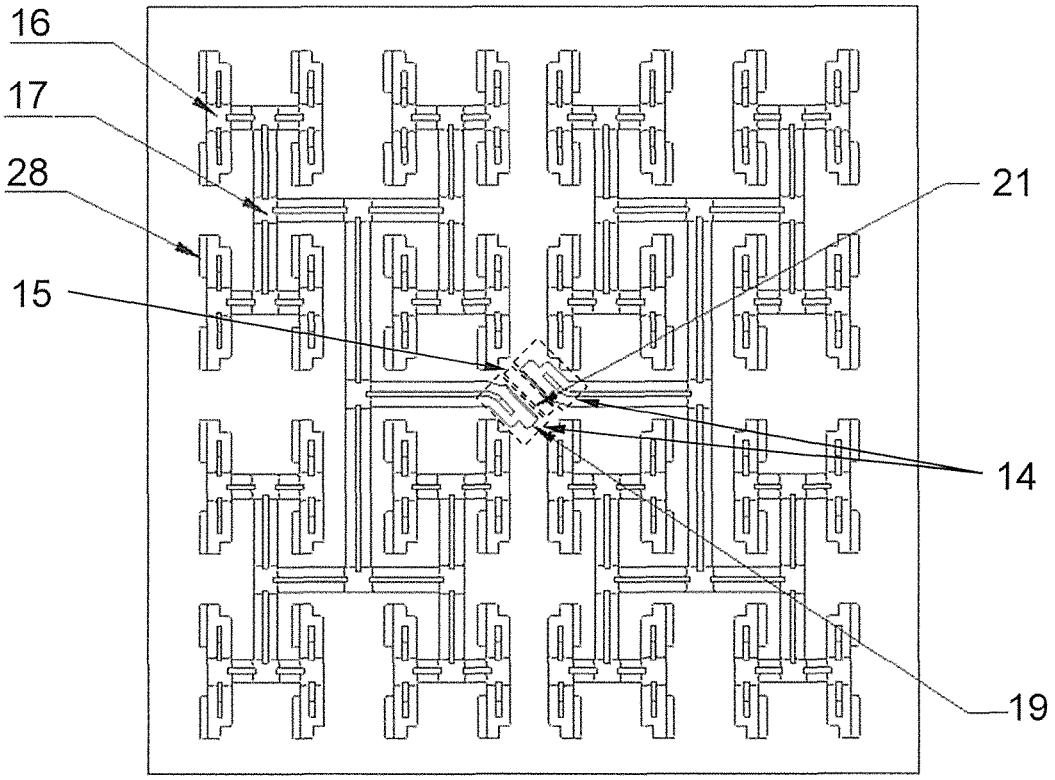
FIG. 10 is a structural diagram of a feed layer of the waveguide slotted array antenna of the invention.

As is shown in FIG. 10, the feed layer 1 comprises $$\left(\frac{n}{2^1}\right)^2$$

H-shaped single ridge waveguide power division networks, two rectangular waveguide-single ridge waveguide converters 14 and an E-plane waveguide power divider 15.

Each H-shaped single ridge waveguide power division network is provided with an input terminal and four output terminals. Each rectangular waveguide-single ridge waveguide converter 14 is provided with a rectangular waveguide input terminal and a single ridge waveguide output terminal.

The $$\left(\frac{n}{2^1}\right)^2$$

H-shaped single ridge waveguide power division networks are evenly distributed to form a first-level feed network array including $$\frac{n}{2^1}$$

rows and $$\frac{n}{2^1}$$

columns, and the H-shaped single ridge waveguide power division networks in every two rows and two columns of the first-level feed network array form a first-level H-shaped single ridge waveguide power division network unit, and the first-level feed network array includes $$\frac{\left(\frac{n}{2^1}\right)^2}{4}$$

first-level H-shaped single ridge waveguide power division network units; the input terminals of the four H-shaped single ridge waveguide power division networks 16 in each first-level H-shaped single ridge waveguide power division network unit are connected through one H-shaped single ridge waveguide power division network; the H-shaped single ridge waveguide power division networks through which the input terminals of the four H-shaped single ridge waveguide power division networks 16 in each of the $$\frac{\left(\frac{n}{2^1}\right)^2}{4}$$

first-level H-shaped single ridge waveguide power division network units are connected form a second-level feed network array including $$\frac{n}{2^2}$$

rows and $$\frac{n}{2^2}$$

columns, the H-shaped single ridge waveguide power division networks in every two rows and two columns of the second-level feed network array form a second-level H-shaped single ridge waveguide power division network unit, the second-level feed network array include $$\frac{\left(\frac{n}{2^1}\right)^2}{4^2}$$

second-level H-shaped single ridge waveguide power division network units, and the input terminals of the four H-shaped single ridge waveguide power division networks 17 in each second-level H-shaped single ridge waveguide power division network unit are connected through one H-shaped single ridge waveguide power division network; by this by analogy, a (k−1)th-level H-shaped single ridge waveguide power division network unit including only four H-shaped single ridge waveguide power division networks is finally formed, and the input terminals of the four H-shaped single ridge waveguide power division networks in the (k−1)th-level H-shaped single ridge waveguide power division network unit are also connected through one H-shaped single ridge waveguide power division network; the single ridge waveguide output terminals of the two rectangular waveguide-single ridge waveguide converters 14 are both connected with the input terminal of the H-shaped single ridge waveguide power division network through which the four H-shaped single ridge waveguide power division networks in the (k−1)th-level H-shaped single ridge waveguide power division network unit are connected, the rectangular waveguide input terminals of the two rectangular waveguide-single ridge waveguide converters 14 are both connected with the output terminal of the E-plane waveguide power divider 15, and the input terminal of the E-plane waveguide power divider 15 serves as the input terminal of the array antenna; the four output terminals of each H-shaped single ridge waveguide power division network in the first-level feed network array are provided with single ridge waveguide-rectangular waveguide converters 28 respectively, and the $n^2$ single ridge waveguide-rectangular waveguide converters 28 are connected with the $n^2$ input ports 7 in the first radiation unit in a one-to-one correspondence mode.

Figure 11:
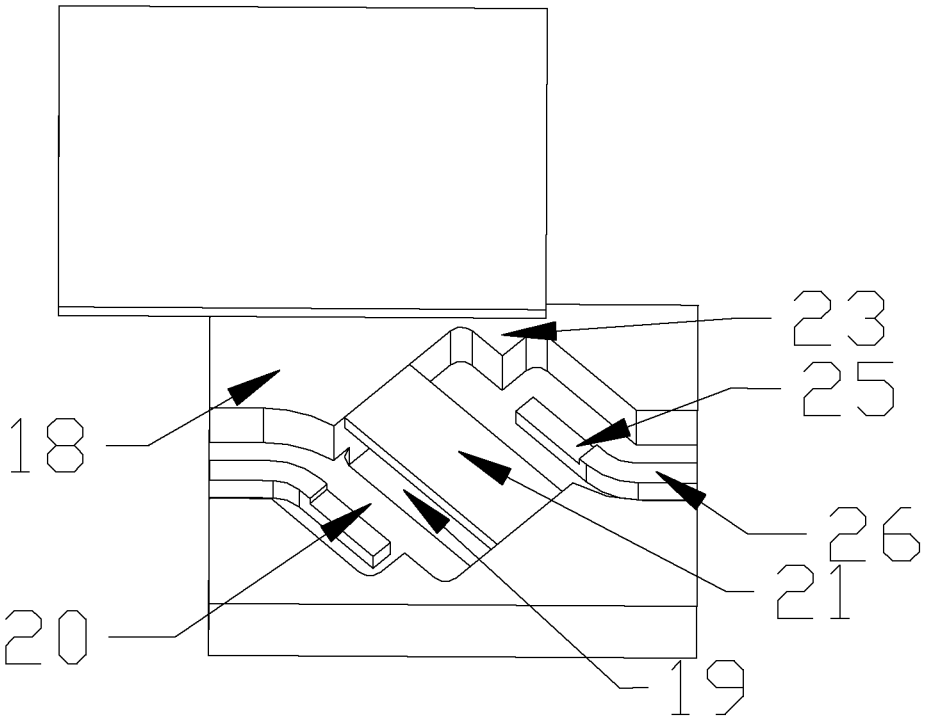
FIG. 11(*a*) is a first structural diagram of a rectangular waveguide-single ridge waveguide converter of the waveguide slotted array antenna of the invention.
Figure 11:
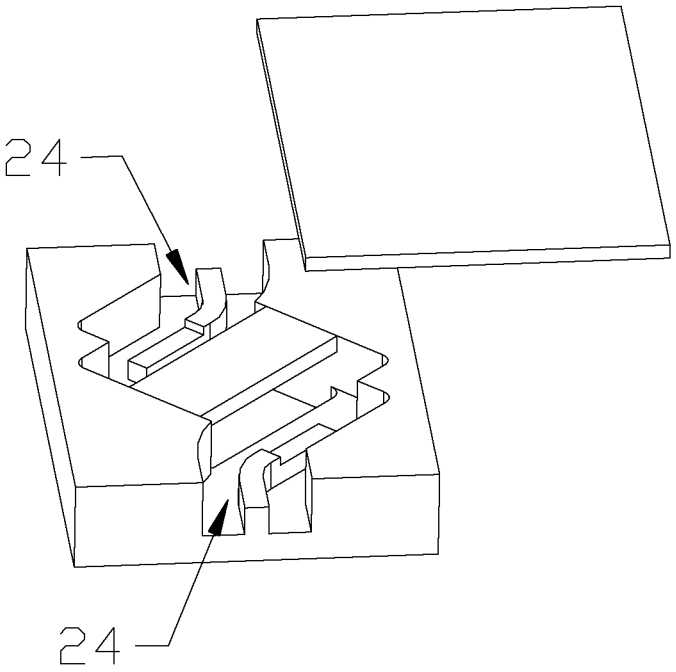
Figure 12:
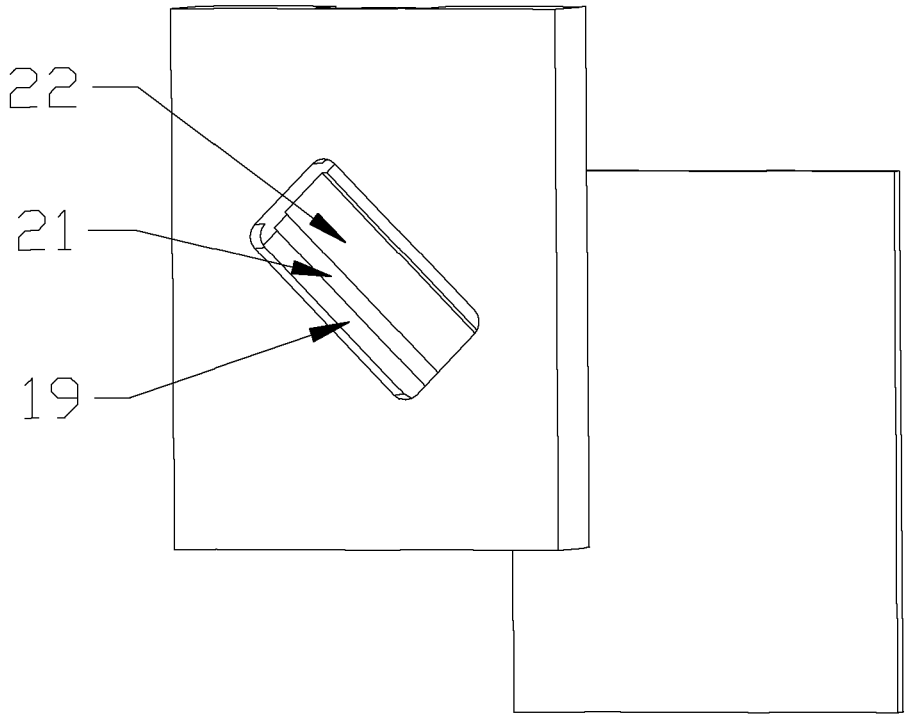
FIG. 12 is a structural diagram of the back side of the rectangular waveguide-single ridge waveguide converter of the waveguide slotted array antenna of the invention.

As is shown in FIG. 11(*a*), FIG. 11(*b*) and FIG. 12, each rectangular waveguide-single ridge waveguide converter 14 comprises a first rectangular metal block 18, wherein a rectangular waveguide input port 19 and a first rectangular cavity 20 are sequentially formed in the first rectangular metal block 18 from front to back; the rectangular waveguide input port 19 is formed in the lower end face of the first rectangular metal block 18, the vertical central line of the first rectangular metal block 18 coincides with the central axis of the rectangular waveguide input port 19 after anticlockwise rotating by 45 degrees, the rectangular waveguide input port 19 is communicated with the first rectangular cavity 20, and the length of the rectangular waveguide input port 19 is equal to that of the first rectangular cavity 20; a first E-plane step 21 and a second E-plane step 22 are arranged in the first rectangular cavity 20 and located over the rectangular waveguide input port 19; the upper end face of the first E-plane step 21 is located on the same plane with the upper side wall of the first rectangular cavity 20, the lower end face of the first E-plane step 21 is connected with the upper end face of the second E-plane step 22 in an attached mode, the front end face of the first E-plane step 21 is connected with the front side wall of the first rectangular cavity 20, and the rear end face of the first E-plane step 21 is connected with the rear side wall of the first rectangular cavity 20; the front end face of the second E-plane step 22 is connected with the front side wall of the first rectangular cavity 20, and the rear end face of the second E-plane step 22 is connected with the rear side wall of the first rectangular cavity 20; the width of the first E-plane step 21 is smaller than that of the rectangular waveguide input port 19, the width of the second E-plane step 22 is smaller than that of the first E-plane step 21, and the length of the first E-plane step 21 is equal to that of the second E-plane step 22 and also equal to that of the rectangular waveguide input port 19; a first H-plane step 23 is arranged on the right side of the first rectangular cavity 20 and connected with the right side wall and the front side wall of the first rectangular cavity 20, and the height of the first H-plane step 23 is equal to that of the first rectangular cavity 20; a single ridge waveguide output port 24 extending to the first rectangular cavity 20 is formed in the rear end face of the first rectangular metal block 18, and the single ridge waveguide output port 24 is rectangular; the vertical central line of the rectangular waveguide input port 19 coincides with the central axis of the single ridge waveguide output port 24 after anticlockwise rotating by 135 degrees, and the single ridge waveguide output port 24 is communicated with the first rectangular cavity 20; the height of the single ridge waveguide output port 24 is equal to that of the first rectangular cavity 20, and the width of the single ridge waveguide output port 24 is smaller than that of the first rectangular cavity 20; a first ridge stair extending into the first rectangular cavity 20 is arranged at the center of the bottom of the single ridge waveguide output port 24 and comprises a first ridge step 25 and a second ridge step 26 which are connected in sequence, the first ridge step 25 and the second ridge step 26 are both rectangular, the front end face of the first ridge step 25 is located in the first rectangular cavity 20, the front end face of the second ridge step 26 is connected with the rear end face of the first ridge step 25 in an attached mode, and the rear end face of the second ridge step 26 is flush with the rear end face of the first rectangular metal block 18; the height of the second ridge step 26 is smaller than that of the single ridge waveguide output port 24, and the height of the first ridge step 25 is smaller than that the second ridge step 26.

Figure 13:
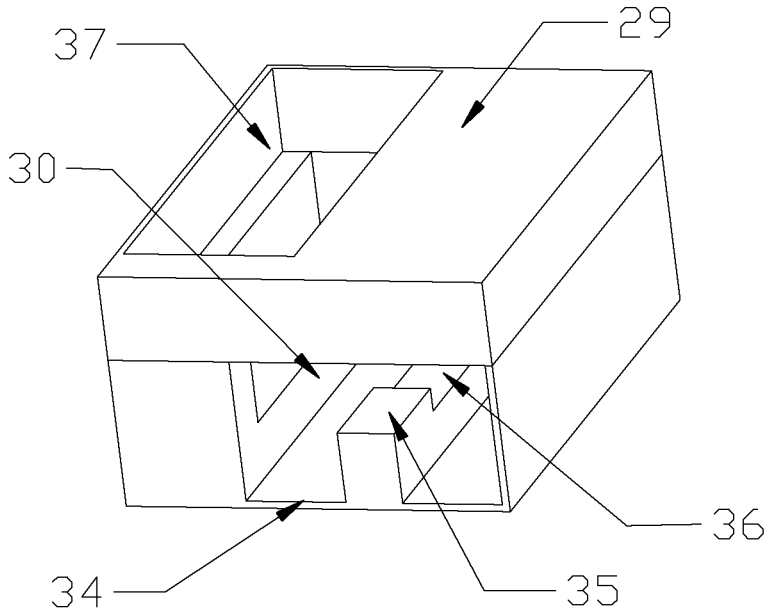
FIG. 13 is a structural diagram of a single ridge waveguide-rectangular waveguide converter of the waveguide slotted array antenna of the invention.
Figure 14:
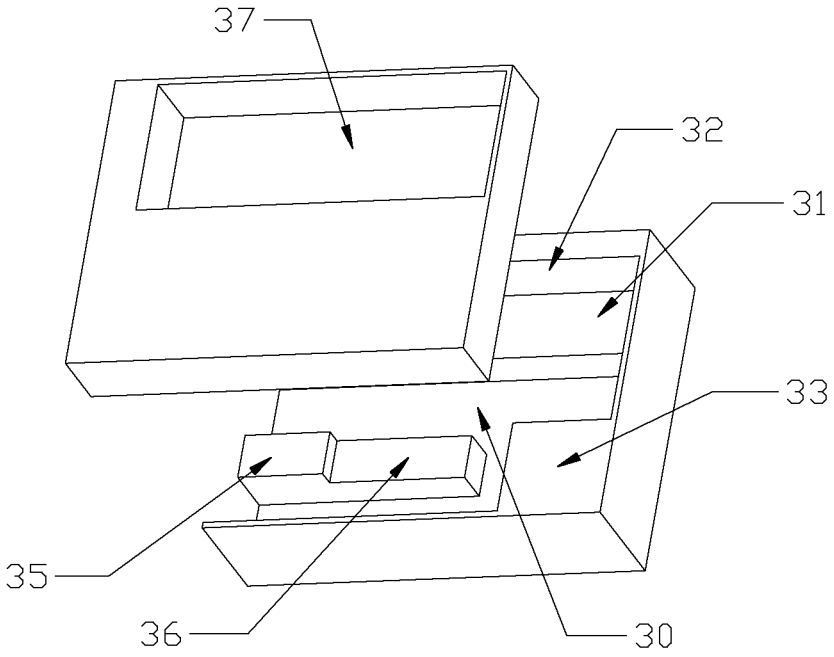
FIG. 14 is an internal structural diagram of the single ridge waveguide-rectangular waveguide converter of the waveguide slotted array antenna of the invention.

As is shown in FIG. 13 and FIG. 14, each single ridge waveguide-rectangular waveguide converter 28 comprises a first rectangular metal block 29, a first rectangular cavity 30 is formed in the first rectangular metal block 29, and a first E-plane step 31 and a second E-plane step 32 are arranged on the left side of the first rectangular cavity 30; the height of the first E-plane step 31 is smaller than that of the first rectangular cavity 30, and the first E-plane step 31 is connected with the front side wall, the rear side wall and the left side wall of the first rectangular cavity 30; the second E-plane step 32 is located on the first E-plane step 31, the lower surface of the second E-plane step 32 is connected with the upper surface of the first E-plane step 31 in an attached mode, the width of the second E-plane step 32 is smaller than that of the first E-plane step 31, and the second E-plane step 32 is connected with the front side wall, the rear side wall and the left side wall of the first rectangular cavity 30; a first H-plane step 33 is arranged on the right side of the first rectangular cavity 30 and connected with the right side wall and the rear side wall of the first rectangular cavity 30, and the height of the first H-plane step 33 is equal to that of the first rectangular cavity 30; a rectangular waveguide output port 37 communicated with the first rectangular cavity 30 is formed in the upper surface of the first rectangular metal block 29; a single ridge waveguide input port 34 is formed in the front side face of the first rectangular metal block 29 and communicated with the first rectangular cavity 30, and the height of the single ridge waveguide input port 34 is equal to that of the first rectangular cavity 30; the bottom surface of the single ridge waveguide input port 34 is located on the same plane with the bottom surface of the first rectangular cavity 30, and a first H-plane ridge stair extending onto the bottom surface of the first rectangular cavity 30 is arranged on the bottom surface of the single ridge waveguide input port 34; the first H-plane ridge stair comprises a first ridge step 35 and a second ridge step 36 which are connected in sequence, the height of the first ridge step 35 is greater than that of the second ridge step 36 and smaller than that of the first rectangular cavity 30.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A waveguide slotted array antenna, comprising:

a feed layer; and a radiation layer, wherein the feed layer is located below the radiation layer, wherein the radiation layer comprises a first radiation unit, a second radiation unit, a third radiation unit and a fourth radiation unit which are stacked from bottom to top, wherein the first radiation unit comprises a first flat metal plate and a first radiation array arranged on the first flat metal plate, wherein the first radiation array comprises $n^2$ radiation cavities which are arranged at intervals, wherein $n=2^k$, and k is a positive integer which is equal to or greater than two, wherein the $n^2$ radiation cavities are rectangular concave cavities formed in the upper surface of the first flat metal plate, and the $n^2$ radiation cavities are distributed on the first flat metal plate in n rows and n columns, wherein first matching plates are separately arranged in the middle of the front side wall and the middle of the rear side wall of each radiation cavity, and second matching plates are separately arranged in the middle of the left side wall and the middle of the right side wall of each radiation cavity; with the front side wall direction of each radiation cavity as the length direction and the left side wall direction of each radiation cavity as the width direction, the height of each first matching plate and the height of each second matching plate are equal to that of each radiation cavity; the upper end faces of the first matching plates and the upper end faces of the second matching plates are located on the same plane with the upper end face of the first flat metal plate, wherein the length of each first matching plate is smaller than one fifth of the length of each radiation cavity, and the width of each first matching plate is smaller than one fifth of the width of each radiation cavity; the length of each second matching plate is smaller than one fifth of the length of each radiation cavity, and the width of each second matching plate is smaller than one third of the width of each radiation cavity, wherein an input port extending to the lower surface of the first flat metal plate is arranged at the bottom end of each radiation cavity, and the input ports are rectangular ports; the front side wall of each input port is parallel to the front side wall of the corresponding radiation cavity, the left side wall of each input port is parallel to the left side wall of the corresponding radiation cavity, the center of each input port overlaps with the center of the corresponding radiation cavity, the length of each input port is smaller than the distance between the two corresponding second matching plates, and the width of each input port is smaller than the distance between the two corresponding first matching plates, wherein the second radiation unit comprises a second flat metal plate and a second radiation array arranged on the second flat metal plate, wherein the second radiation array comprises $n^2$ first radiation sets which are arranged at intervals, and the $n^2$ first radiation sets are distributed on the second flat metal plate in n rows and n columns and communicated with the $n^2$ radiation cavities in a one-to-one correspondence mode, wherein each first radiation set comprises four first radiation holes which are distributed in two rows and two columns at intervals, wherein the first radiation holes are rectangular holes extending from the upper surface to the lower surface of the second flat metal plate, the four first radiation holes in the first radiation set are located over the $n^2$ radiation cavities correspondingly communicated with the four first radiation holes; the front side walls of the two first radiation holes located in the first row are flush with the front side walls of the corresponding $n^2$ radiation cavities, and the rear side walls of the two first radiation holes located in the second row are flush with the rear side walls of the corresponding $n^2$ radiation cavities; the left side walls of the two first radiation holes located in the first column are flush with the left side walls of the corresponding $n^2$ radiation cavities, and the right side walls of the two first radiation holes located in the second column are flush with the right side walls of the corresponding $n^2$ radiation cavities, wherein the third radiation unit comprises a third flat metal plate and a third radiation array arranged on the third flat metal plate, wherein the third radiation array comprises $n^2$ second radiation sets which are arranged at intervals, and the $n^2$ second radiation sets are distributed on the third flat metal plate in n rows and n columns and communicated with the $n^2$ first radiation sets in a one-to-one correspondence mode, wherein each second radiation set comprises four second radiation holes which are distributed in two rows and two columns at intervals, wherein the second radiation holes are rectangular holes extending from the upper surface to the lower surface of the third flat metal plate, the four second radiation holes in the second radiation set completely overlap with the four first radiation holes in the first radiation set communicated with the second radiation set in a one-to-one correspondence mode after clockwise rotating by 22.5 degrees around the center, the fourth radiation unit comprises a fourth flat metal plate and a fourth radiation array arranged on the fourth flat metal plate, wherein the fourth radiation array comprises $n^2$ third radiation sets which are arranged at intervals, and the $n^2$ third radiation sets are distributed on the fourth flat metal plate in n rows and n columns and communicated with the $n^2$ second radiation sets in a one-to-one correspondence mode, wherein each third radiation set comprises four third radiation holes which are distributed in two rows and two columns at intervals, wherein the third radiation holes are rectangular holes extending from the upper surface to the lower surface of the fourth flat metal plate, the four third radiation holes in the third radiation set are communicated with the four second radiation holes in the corresponding second radiation set in a one-to-one correspondence mode, and the center of each third radiation hole overlaps with the center of the second radiation hole communicated with the third radiation hole; each third radiation hole can anticlockwise deflect by 22.5 degrees around the center relative to the corresponding second radiation hole, wherein the length of each third radiation hole is greater than that of each second radiation hole and smaller than 1.5 times of the length of each second radiation hole, and the width of each third radiation hole is greater than two times of the width of each second radiation hole and smaller than three times of the width of each second radiation hole;

wherein a rectangular metal strip is arranged in each third radiation hole, wherein the left end face of the rectangular metal strip is connected with the left side wall of the third radiation hole, and the right end face of the rectangular metal strip is connected with the right side wall of the third radiation hole; the distance from the front end face of the rectangular metal strip to the front side wall of the third radiation hole is equal to the distance from the rear end face of the rectangular metal strip to the rear side wall of the third radiation hole; the upper end face of the rectangular metal strip is located on the same plane with the upper end face of the fourth flat metal plate, wherein the height of the rectangular metal strip is smaller than that of the third radiation hole, the width of the rectangular metal strip is smaller than one third of the width of third radiation hole, and the length of the rectangular metal strip is equal to that of the third radiation hole, wherein the first flat metal plate, the second flat metal plate, the third flat metal plate and the fourth flat metal plate are rectangular plates with equal lengths and widths, and the edges of the four flat metal plates are aligned.

2. The waveguide slotted array antenna according to claim 1, wherein the feed layer comprises $$\left(\frac{n}{2^1}\right)^2$$

H-shaped single ridge waveguide power division networks, two rectangular waveguide-single ridge waveguide converters and an E-plane waveguide power divider, wherein each H-shaped single ridge waveguide power division network is provided with an input terminal and four output terminals, wherein each rectangular waveguide-single ridge waveguide converter is provided with a rectangular waveguide input terminal and a single ridge waveguide output terminal, wherein the $$\left(\frac{n}{2^1}\right)^2$$

H-shaped single ridge waveguide power division networks are evenly distributed to form a first-level feed network array including $$\frac{n}{2^1}$$

rows and $$\frac{n}{2^1}$$

columns, and the H-sharp single ridge waveguide power division networks in every two rows and two columns of the first-level feed network array form a first-level H-shaped single ridge waveguide power division network unit, and the first-level feed network array includes $$\frac{\left(\frac{n}{2^1}\right)^2}{4}$$

first-level H-shaped single ridge waveguide power division network units; the input terminals of the four H-shaped single ridge waveguide power division networks in each first-level H-shaped single ridge waveguide power division network unit are connected through one H-shaped single ridge waveguide power division network, wherein the H-shaped single ridge waveguide power division networks through which the input terminals of the four H-shaped single ridge waveguide power division networks in each of the $$\frac{\left(\frac{n}{2^1}\right)^2}{4}$$

first-level H-shaped single ridge waveguide power division network units are connected form a second-level feed network array including $$\frac{n}{2^2}$$

rows and $$\frac{n}{2^2}$$

columns, the H-shaped single ridge waveguide power division networks in every two rows and two columns of the second-level feed network array form a second-level H-shaped single ridge waveguide power division network unit, the second-level feed network array includes $$\frac{\left(\frac{n}{2^1}\right)^2}{4^2}$$

second-level H-shaped single ridge waveguide power division network units, and the input terminals of the four H-shaped single ridge waveguide power division networks in each second-level H-shaped single ridge waveguide power division network unit are connected through one H-shaped single ridge waveguide power division network, wherein, a (k−1)th-level H-shaped single ridge waveguide power division network unit including only four H-shaped single ridge waveguide power division networks is finally formed, and the input terminals of the four H-shaped single ridge waveguide power division networks in the (k−1)th-level H-shaped single ridge waveguide power division network unit are also connected through one H-shaped single ridge waveguide power division network, wherein the single ridge waveguide output terminals of the two rectangular waveguide-single ridge waveguide converters are both connected with the input terminal of the H-shaped single ridge waveguide power division network through which the four H-shaped single ridge waveguide power division networks in the (k−1)th-level H-shaped single ridge waveguide power division network unit are connected, wherein the rectangular waveguide input terminals of the two rectangular waveguide-single ridge waveguide converters are both connected with the output terminal of the E-plane waveguide power divider, and the input terminal of the E-plane waveguide power divider serves as the input terminal of the array antenna, wherein the four output terminals of each H-shaped single ridge waveguide power division network in the first-level feed network array are provided with single ridge waveguide-rectangular waveguide converters respectively, and the $n^2$ single ridge waveguide-rectangular waveguide converters are connected with the $n^2$ input ports in the first radiation unit in a one-to-one correspondence mode.

3. The waveguide slotted array antenna according to claim 2, wherein each rectangular waveguide-single ridge waveguide converter comprises a first rectangular metal block, wherein a rectangular waveguide input port and a first rectangular cavity are sequentially formed in the first rectangular metal block from front to back, wherein the rectangular waveguide input port is formed in the lower end face of the first rectangular metal block, the vertical central line of the first rectangular metal block coincides with the central axis of the rectangular waveguide input port after anticlockwise rotating by 45 degrees, the rectangular waveguide input port is communicated with the first rectangular cavity, and the length of the rectangular waveguide input port is equal to that of the first rectangular cavity, wherein a first E-plane step and a second E-plane step are arranged in the first rectangular cavity and located over the rectangular waveguide input port, wherein the upper end face of the first E-plane step is located on the same plane with the upper side wall of the first rectangular cavity, the lower end face of the first E-plane step is connected with the upper end face of the second E-plane step in an attached mode, the front end face of the first E-plane step is connected with the front side wall of the first rectangular cavity, and the rear end face of the first E-plane step is connected with the rear side wall of the first rectangular cavity, wherein the front end face of the second E-plane step is connected with the front side wall of the first rectangular cavity, and the rear end face of the second E-plane step is connected with the rear side wall of the first rectangular cavity, wherein the width of the first E-plane step is smaller than that of the rectangular waveguide input port, the width of the second E-plane step is smaller than that of the first E-plane step, and the length of the first E-plane step is equal to that of the second E-plane step and also equal to that of the rectangular waveguide input port, wherein a first H-plane step is arranged on the right side of the first rectangular cavity and connected with the right side wall and the front side wall of the first rectangular cavity, and the height of the first H-plane step is equal to that of the first rectangular cavity, wherein a single ridge waveguide output port extending to the first rectangular cavity is formed in the rear end face of the first rectangular metal block, and the single ridge waveguide output port is rectangular, wherein the vertical central line of the rectangular waveguide input port coincides with the central axis of the single ridge waveguide output port after anticlockwise rotating by 135 degrees, and the single ridge waveguide output port is communicated with the first rectangular cavity, wherein the height of the single ridge waveguide output port is equal to that of the first rectangular cavity, and the width of the single ridge waveguide output port is smaller than that of the first rectangular cavity, wherein a first ridge stair extending into the first rectangular cavity is arranged at the center of the bottom of the single ridge waveguide output port and comprises a first ridge step and a second ridge step which are connected in sequence, the first ridge step and the second ridge step are both rectangular, the front end face of the first ridge step is located in the first rectangular cavity, the front end face of the second ridge step is connected with the rear end face of the first ridge step in an attached mode, and the rear end face of the second ridge step is flush with the rear end face of the first rectangular metal block, wherein the height of the second ridge step is smaller than that of the single ridge waveguide output port, and the height of the first ridge step is smaller than that of the second ridge step.

4. The waveguide slotted array antenna according to claim 2, wherein each single ridge waveguide-rectangular waveguide converter comprises a first rectangular metal block, a first rectangular cavity is formed in the first rectangular metal block, and a first E-plane step and a second E-plane step are arranged on the left side of the first rectangular cavity, wherein the height of the first E-plane step is smaller than that of the first rectangular cavity, and the first E-plane step is connected with the front side wall, the rear side wall and the left side wall of the first rectangular cavity, wherein the second E-plane step is located on the first E-plane step, the lower surface of the second E-plane step is connected with the upper surface of the first E-plane step in an attached mode, the width of the second E-plane step is smaller than that of the first E-plane step, and the second E-plane step is connected with the front side wall, the rear side wall and the left side wall of the first rectangular cavity, wherein a first H-plane step is arranged on the right side of the first rectangular cavity and connected with the right side wall and the rear side wall of the first rectangular cavity, and the height of the first H-plane step is equal to that of the first rectangular cavity, wherein a rectangular waveguide output port communicated with the first rectangular cavity is formed in the upper surface of the first rectangular metal block, wherein a single ridge waveguide input port is formed in the front side face of the first rectangular metal block and communicated with the first rectangular cavity, the height of the single ridge waveguide input port is equal to that of the first rectangular cavity, and the bottom surface of the single ridge waveguide input port is located on the same plane with the bottom surface of the first rectangular cavity, wherein a first H-plane step ridge stair extending onto the bottom surface of the first rectangular cavity is arranged on the bottom surface of the single ridge waveguide input port and comprises a first ridge step and a second ridge step, and the height of the first ridge step is greater than that of the second ridge step and smaller than that of the first rectangular cavity.

* * * * *